US012564267B2

(12) United States Patent
Ding et al.

(10) Patent No.: US 12,564,267 B2
(45) Date of Patent: Mar. 3, 2026

(54) FOLDABLE SOFA BED

(71) Applicant: Anji Longwin Furniture Co., Ltd., Huzhou City (CN)

(72) Inventors: Chen Ding, Huzhou City (CN); Zhongjian Huang, Huzhou City (CN); Xuezhong He, Huzhou City (CN)

(73) Assignee: Anji Longwin Furniture Co., Ltd., Huzhou City (CN)

( * ) Notice: Subject to any disclaimer, the term of this patent is extended or adjusted under 35 U.S.C. 154(b) by 83 days.

(21) Appl. No.: 18/611,875

(22) Filed: Mar. 21, 2024

(65) Prior Publication Data

US 2025/0151915 A1 May 15, 2025

(30) Foreign Application Priority Data

Nov. 10, 2023 (CN) ..... 202323039654.9

(51) Int. Cl.
*A47C 17/22* (2006.01)

(52) U.S. Cl.
CPC ..... *A47C 17/225* (2013.01)

(58) Field of Classification Search
CPC ..... A47C 17/86; A47C 17/17; A47C 17/04; A47C 19/021; A47C 17/16; A47C 19/122; A47C 17/225; A47C 27/00
USPC ..... 5/12.1, 14, 13
See application file for complete search history.

(56) References Cited

U.S. PATENT DOCUMENTS 3,108,291 A * 10/1963 Eason ..... A47C 17/68 5/150.1
2021/0037984 A1* 2/2021 Zhu ..... A47C 17/70

FOREIGN PATENT DOCUMENTS

GB 1040873 A * 9/1966 ..... A47C 19/122
GB 2537027 A * 10/2016 ..... A47C 19/122

* cited by examiner

*Primary Examiner* — Madison Emanski
(74) *Attorney, Agent, or Firm* — Olive Law Group, PLLC

(57) ABSTRACT

Embodiments provide a foldable sofa bed. In the embodiments, the foldable sofa bed includes a sofa frame, a foldable bed frame and at least one folding support assembly; the foldable bed frame comprises a first folding frame and a second folding frame, and the at least one folding support assembly is mounted at a location where the first folding frame and the second folding frame are connected; each side of the sofa frame is provided with a rotary connector configured for connecting the first folding frame, and the first folding frame is capable to be unfolded towards a front of the sofa frame, to easily convert the sofa into a bed; the foldable bed frame is in a folded state; the foldable bed frame is in a folded state, the second folding frame is provided over the first folding frame by the folding support assembly.

3 Claims, 4 Drawing Sheets

FOLDABLE SOFA BED

RELATED APPLICATIONS

The present disclosure claims priority to Chinese Patent Application No. 202323039654.9, filed on Nov. 10, 2023, which is incorporated herein by reference.

TECHNICAL FIELD

The present disclosure relates to the technical field of furniture, and in particular, to a foldable sofa bed.

BACKGROUND

A foldable sofa bed is a multifunctional furniture that can be used as a sofa when needed, or unfolded into a bed for people to rest. It usually consists of a foldable frame and a cushion. The frame is usually made of metal or wood with folding and unfolding functions to allow for conversion when needed, and the cushion is usually made of a sponge or other soft material to provide a comfortable seating and sleeping experience.

Chinese Patent with a Publication No. CN204970394U" discloses a folding sofa bed, comprising a sofa and a folding bed. The sofa comprises a backrest portion and a cushion portion, with a through-length groove extending along the length direction of the cushion at the intersection of the backrest portion and the cushion portion. The folding bed comprises a support frame and a mattress, the support frame comprises three base plates that can be folded into each other, and the support base plates being a first end plate, a middle plate and a second end plate. The first end plate is provided on the cushion part of the sofa, the end of the first end plate adjacent to the sofa side is provided with a short outrigger at the bottom end, which is inserted into the through-length groove and fixed to the sofa's cushion part of the sofa. The bottom ends of the middle plate and the middle part of the second end plate are respectively provided with legs.

SUMMARY

A foldable sofa bed that is easy to unfold and fold and has a high space utilization rate is provided.

The technical solution of the present disclosure is as follows: a foldable sofa bed comprises a foldable bed frame and a folding support assembly; the foldable bed frame comprises a first folding frame and a second folding frame, and the folding support assembly is mounted at a location where the first folding frame and the second folding frame are connected.

As preferred, the folding support assembly comprises a U-shaped connector and a first support leg, an end of the first support leg is fixed vertically to the U-shaped connector.

As preferred, the U-shaped connector is assembled with a plurality of rotary connecting columns at both ends of the U-shaped connector, the plurality of rotary connecting columns are configured for fixing the first folding frame and the U-shaped connector, and for fixing the second folding frame and the U-shaped connector.

As preferred, the second folding frame is assembled with two second support legs, and the second folding frame and each second support leg are connected by a fixing connection assembly.

As preferred, the fixing connection assembly comprises a fixing member and a rotary member, the fixing member is fixed to an inner side of the second folding frame, the rotary member is fixed to an end of the second support leg, and the rotary member is rotationally connected with the fixing member.

As preferred, a second connecting rod is assembled between the first support leg and the second support leg, and both ends of the second connecting rod are rotationally mounted on inner sides of the first support leg and the second support leg.

As preferred, a support rod is assembled between the two second support legs.

As preferred, the foldable sofa bed further comprises a sofa frame, both sides of the sofa frame are provided with rotary connectors configured for connecting the first folding frame, and the first folding frame is capable to be unfolded towards a front of the sofa frame.

As preferred, a first connecting rod is provided between the rotary connector and the first support leg, with one end of the first connecting rod being mounted on an inner side of the rotary connector and another end of the first connecting rod being mounted on an outer side of the first support leg.

As preferred, the first folding frame is assembled with a number of support short rods for supporting the cushions at an end where the first folding frame is connected.

Compared with the prior art, the present disclosure has the following beneficial effects:

The foldable bed frame includes a first folding frame and a second folding frame, such that the length of the foldable bed frame can be ensured and the comfort of the user can be increased. The folding support assembly is used for connecting the first folding frame and the second folding frame, improving the space utilization rate, and allowing the user to easily convert the sofa into a bed or fold the bed into a sofa to adapt to different usage needs.

Further, the end of the first support leg is vertically fixed to the U-shaped connector, which can ensure the stability and reliability of the folding support assembly, such that it can effectively support the entire foldable bed frame. The first support leg does not need to be additionally mounted and dismounted, so as to make the use of the foldable sofa bed more convenient and quicker.

Further, by means of the rotary connecting column, the first folding frame and the second folding frame can freely rotate on the U-shaped connector, to realize the conversion between the sofa and the bed. The rotary connecting column can ensure the bed frame's stability and reliability, such that no accidental loosening or dislodging occurs during the conversion process.

Further, the second support leg is mounted on the second folding frame via the fixing connection assembly, increasing the stability of the foldable bed frame 1. In addition, the second support leg does not need to be additionally mounted and dismounted, which facilitates the user's folding operation.

Further, the fixing member provides sufficient support and stability, and the rotary member can drive the second support leg to rotate, facilitating that the second support leg can be folded together with the second folding frame.

Further, the second rod connects the first support leg and the second support leg, playing a role in increasing the stability and support capacity of the bed frame, and driving the first support leg and the second support leg to be folded when the foldable bed frame is being folded, such that it can make the operation more convenient for the user.

Further, the support rod is used to increase the stability of the second support leg and increase bearing capacity, such that the sofa bed is not easy to shake when in use.

Further, via the rotary connector, the first folding frame can be unfolded in front of the sofa frame to form a foldable sofa bed that can be folded flexibly, and when the first folding frame is unfolded, the sofa frame can provide support and stability for the foldable bed frame, such that the bed frame can be turned into a comfortable bed.

Further, the first rod is mounted between the rotary connector and the first support leg. When folded or unfolded, the first rod allows the first support leg and the first folding frame to be folded together.

Further, the support short rods are used to support the cushion and are mounted at the end where the first folding frame is connected to the sofa frame, providing additional support and stability to ensure that the cushion stays comfortable and evenly supported during use.

Other features and advantages of the present disclosure will be disclosed in detail in the following specific embodiments and figures.

BRIEF DESCRIPTION OF DRAWINGS

The present disclosure is further described below in conjunction with the figures.

Figure 1:
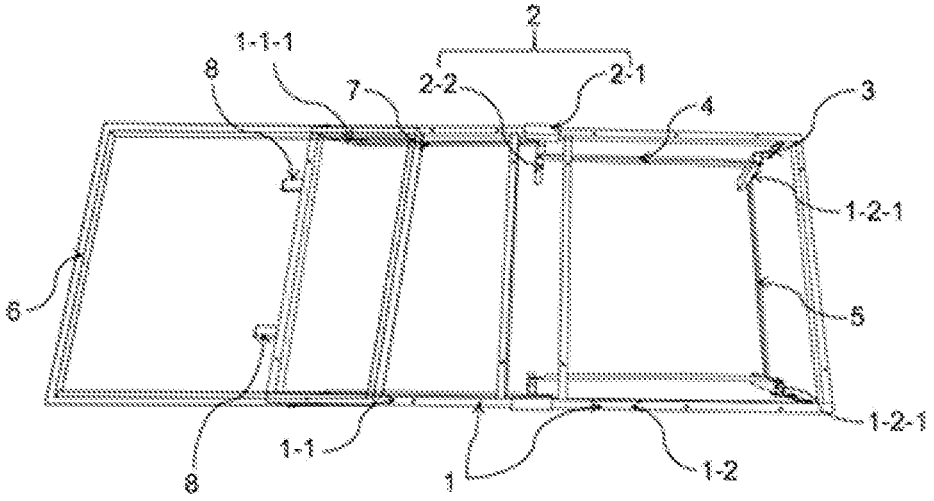
FIG. 1 shows an installation schematic diagram of a foldable sofa bed according to the present disclosure.

The reference signs are described as follows:

Foldable bed frame 1, first folding frame 1-1, second folding frame 1-2;

Folding support assembly 2, U-shaped connector 2-1, first support leg 2-2, rotary connecting column 2-2-1, second support leg 1-2-1;

Fixing connection assembly 3, fixing member 3-1, rotary member 3-2;

Second connecting rod 4, support rod 5;

Sofa frame 6, rotary connector 1-1-1, first connecting rod 7, support short rod 8.

DESCRIPTION OF EMBODIMENTS

The technical solutions of the embodiments of the present disclosure are explained and illustrated below in connection with the figures, but the following embodiments are only the preferred embodiments of the present disclosure and are not exhaustive. Based on the embodiments in the implementations, other embodiments obtained by a person skilled in the art without making inventive efforts fall within the protection scope of the present disclosure.

In the following description, terms such as "inner", "outer", "top", "bottom" "left", "right", etc. are used to indicate orientation or positional relationships only for the convenience of describing the embodiments and to simplify the description, rather intended to indicate or imply that the referred device or element must have a particular orientation, be constructed and operated in a particular orientation, and therefore are not to be construed as limitations of the present disclosure.

As shown in FIG. 1, a foldable sofa bed is mainly formed by a combination of a sofa frame 6 and a foldable bed frame 1. The sofa frame 6 has a rectangular shape and is usually formed by welding a steel frame, such that it has a certain bearing capacity and stability. The foldable bed frame 1 comprises a first folding frame 1-1 and a second folding frame 1-2. The sofa frame 6 is fixed with a rotary connector 1-1-1 on both sides of the sofa frame 6, and the first folding frame 1-1 can be folded over the sofa frame 6 via the rotary connectors 1-1-1, such that the versatility of the foldable sofa bed can be realized.

Wherein the first folding frame 1-1 is mounted with a plurality of support short rods 8 on a steel frame adjacent to the side of the sofa frame 6, the support short rods 8 are used to support the laying of the sofa cushion, increase the contact area between the sofa cushion and the sofa seat 6, such that the sofa cushion will not be plunged into the sofa seat 6, and enhance the comfort of the user.

Wherein, the first folding frame 1-1 and the second folding frame 1-2 are connected by the folding support assembly 2, the folding support assembly 2 comprising a U-shaped connector 2-1 and a first support leg 2-2. The end of the first support leg 2-2 is vertically connected to the U-shaped connector 2-1, ensuring that the entire foldable sofa bed is parallel to the ground when the foldable bed frame 1 is unfolded, and increasing the comfort of the user.

Figure 2:
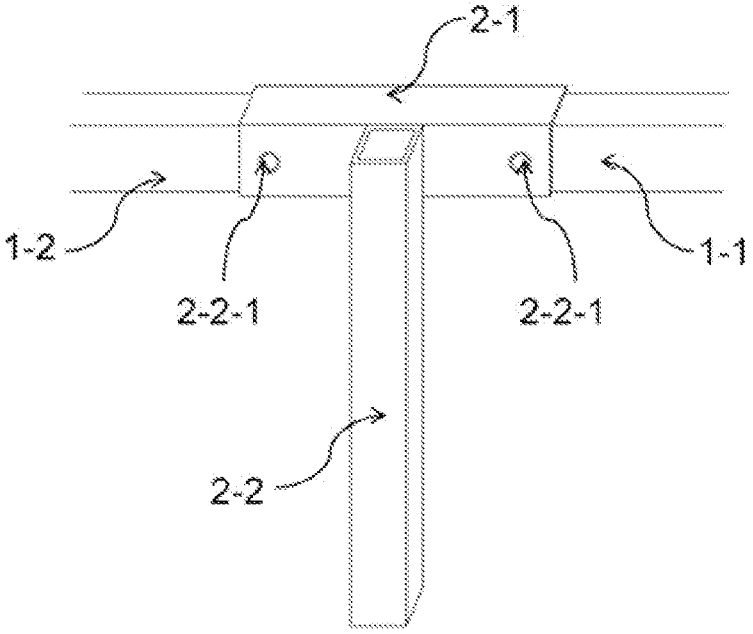
FIG. 2 shows an installation schematic diagram of a folding support assembly according to the present disclosure.
Figure 3:
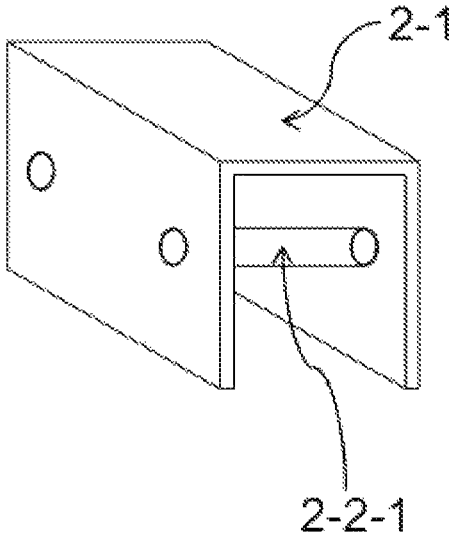
FIG. 3 shows an installation schematic diagram of a U-shaped connector and a rotary connecting column according to the present disclosure.

As shown in FIGS. 2 and 3, the U-shaped connector 2-1 connects the first folding frame 1-1 and the second folding frame 1-2. The joints of the U-shaped connector 2-1 and the first folding frame 1-1, the U-shaped connector 2-1 and the second folding frame 1-2 are connected via the rotary connecting column 2-2-1, and the first folding frame 1-1 and the second folding frame 1-2 can be rotated around the rotary connecting column 2-2-1 towards the opening of the U-shaped connector 2-1, to achieve the rotational folding of the first folding frame 1-1 and the second folding frame 1-2.

Figure 4:
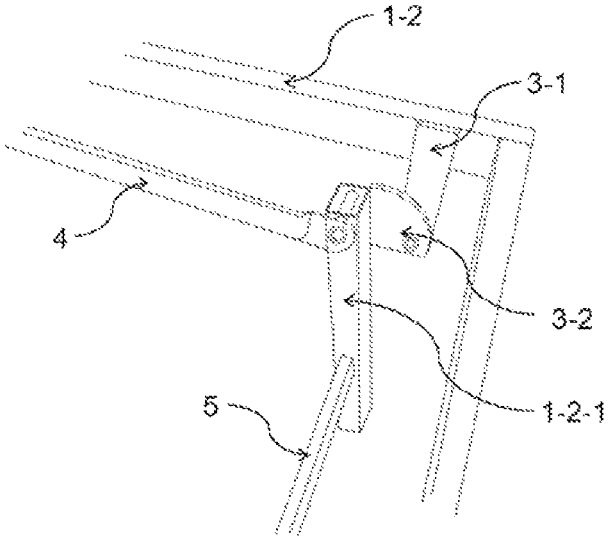
FIG. 4 shows an installation schematic diagram of the fixing connection assembly and the second support leg according to the present disclosure.

As shown in FIG. 4, the second folding frame 1-2 is assembled with the second support leg 1-2-1 via the fixing connection assembly 3, the fixing connection assembly 3 comprising a fixing member 3-1 and a rotary member 3-2. The fixing member 3-1 is vertically welded to the inner side of the second folding frame 1-2, the rotary member 3-2 is mounted on the lower end of the fixing member 3-1, and the rotary member 3-2 is connected to the second support leg 1-2-1 in a welding manner. When folding and receiving the second folding frame 1-2, the rotary member 3-2 can rotate the second folding frame 1-2 around the fixing member 3-1 to receive the second support leg 1-2-1.

Figure 5:
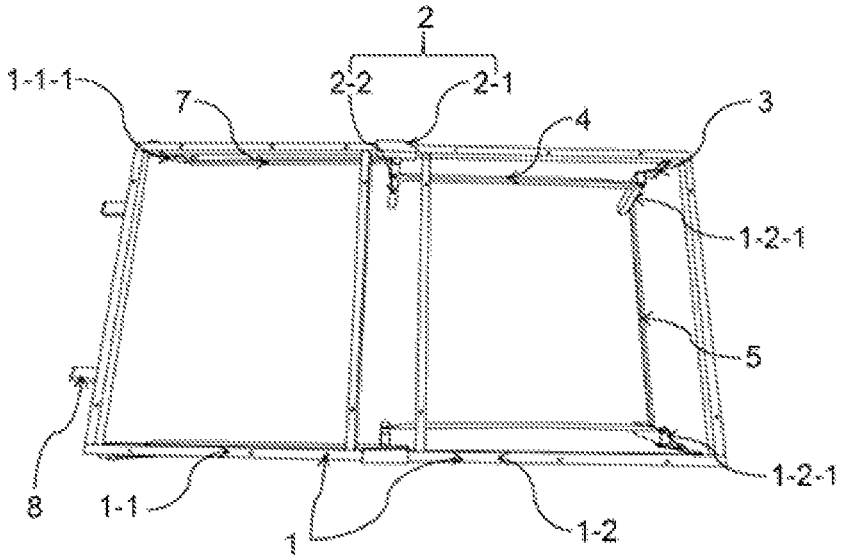
FIG. 5 shows a schematic diagram in a fully unfolded state of the foldable bed frame according to the present disclosure.

As shown in FIG. 5, two second support legs 1-2-1 are provided on the second folding frame 1-2, and a support rod 5 for increasing stability and support is assembled between the two second support legs 1-2-1. The support rod 5 enables the two second support legs 1-2-1 to maintain the same distance and stable perpendicularity to the ground after being subjected to a force, which increases the stability of the entire foldable sofa bed.

Among them, the second connecting rod 4 is mounted between the first support leg 2-2 and the second support leg 1-2-1, with both of the second connecting rods 4 being mounted on the inner side of the first support leg 2-2 and the second support leg 1-2-1. The first connecting rod 7 is mounted between the rotary connector 1-1-1 and the first support leg 2-2, with one end of the first connecting rod 7 being mounted on the inner side of the rotary connector 1-1-1 and the other end being mounted on the outer side of the first support leg 2-2.

Figure 6:
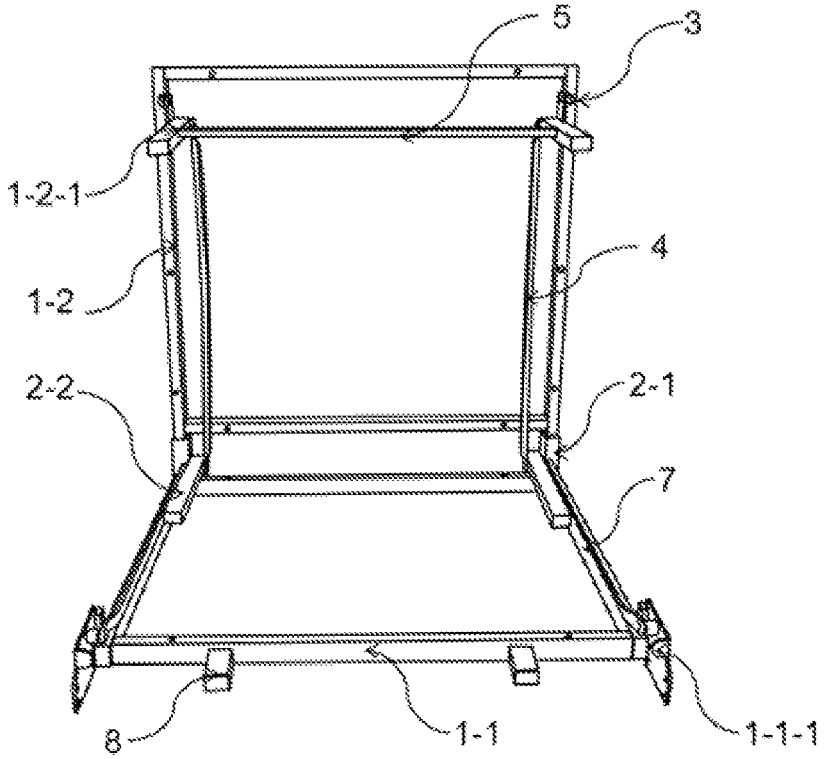
FIG. 6 shows a schematic diagram in a half folding state of the foldable bed frame according to the present disclosure.

As shown in FIG. 6, when folding the foldable bed frame 1, the second folding frame 1-2 is lifted, to make the first support leg 2-2 leave the ground, and the U-shaped connector 2-1 folds the first folding frame 1-1 and the second folding frame 1-2. During the folding process, the first folding frame 1-1 rotates toward the top of the sofa frame 6 through the rotating connector 1-1-1, and the first connecting rod 7 drives the first support leg 2-2 rotates, such that it is folded together with the first support frame 1-1, and the first support leg 2-2 drives the second support leg 1-2-1 connected to the second connecting rod 4, such that the second support leg 1-2-1, the first support frame 1-1, and the second support frame 1-2 are folded together to complete the folding.

Figure 7:
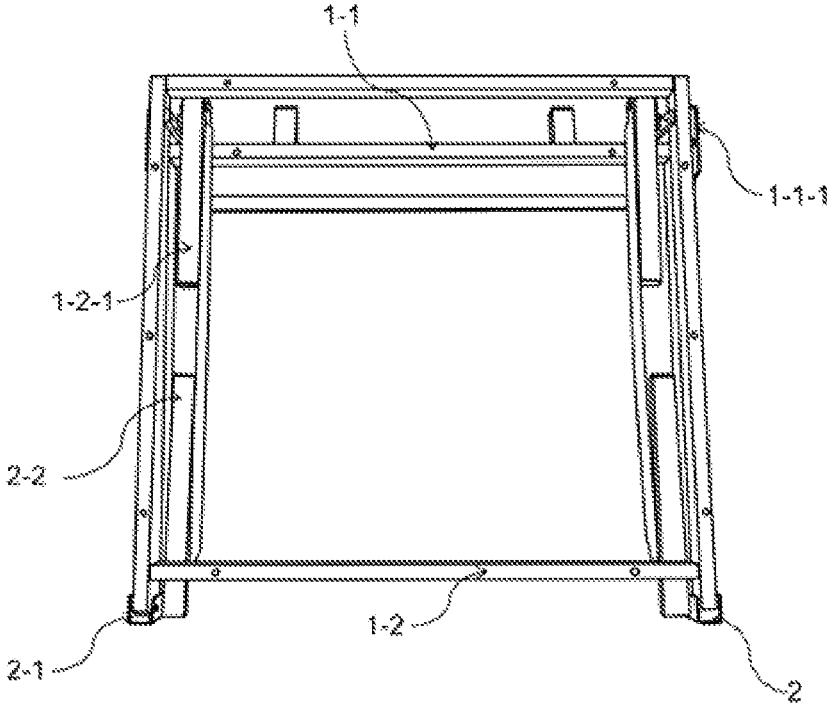
FIG. 7 shows a schematic diagram of the foldable bed frame according to the present disclosure when folded.

As shown in FIG. 7, the foldable bed frame 1 is in a folded state, the second folding frame 1-2 is provided over the first folding frame 1-1, and the first support leg 2-2 and the second support leg 1-2-1 are in the same plane.

The above description is only a specific embodiment of the present disclosure, but the present disclosure is not limited thereto, and a person skilled in the art familiar with the field should understand that the present disclosure includes, but is not limited to, the contents described in the figures and the specific embodiments above. Any modifications that do not deviate from the functional and structural principles of the present disclosure will be included in the claims.

What is claimed is:

1. A foldable sofa bed, comprising a sofa frame, a foldable bed frame and at least one folding support assembly; wherein the foldable bed frame comprises a first folding frame and a second folding frame, and the at least one folding support assembly is mounted at a location where the first folding frame and the second folding frame are connected; each side of the sofa frame is provided with a rotary connector configured for connecting the first folding frame, and the first folding frame is capable to be unfolded towards a front of the sofa frame; the at least one folding support assembly comprises a U-shaped connector and a first support leg, an end of the first support leg is fixed vertically to the U-shaped connector; a first connecting rod is provided between the rotary connector and the first support leg, with one end of the first connecting rod being mounted on an inner side of the rotary connector and another end of the first connecting rod being mounted on an outer side of the first support leg; the second folding frame is assembled with two second support legs, and the second folding frame and each second support leg are connected by a fixing connection assembly; the fixing connection assembly comprises a fixing member and a rotary member, the fixing member is fixed to an inner side of the second folding frame, the rotary member is fixed to an end of a corresponding second support leg, and the rotary member is rotationally connected with the fixing member; a second connecting rod is assembled between the first support leg and a corresponding second support leg, and both ends of the second connecting rod are mounted on inner sides of the first support leg and the corresponding second support leg; the U-shaped connector is assembled with a plurality of rotary connecting columns at both ends of the U-shaped connector, the plurality of rotary connecting columns are configured for fixing the first folding frame and the U-shaped connector, and for fixing the second folding frame and the U-shaped connector; the first folding frame and the second folding frame is rotatable around the rotary connecting column towards the opening of the U-shaped connector, to achieve the rotational folding of the first folding frame and the second folding frame; the first folding frame rotates toward the top of the sofa frame through the rotating connector, and the first connecting rod drives the first support leg rotates, such that the sofa frame is folded together with the first support frame, and the first support leg drives the second support leg connected to the second connecting rod, such that the second support leg, the first support frame, and the second support frame are folded together to complete the folding, the foldable bed frame is in a folded state, the second folding frame is provided over the first folding frame, and the first support leg and the second support leg are in the same plane; the first support leg and the second support leg is used to ensure that the entire foldable sofa bed is parallel to a ground when the foldable bed frame is unfolded.

2. The foldable sofa bed according to claim 1, wherein a first support rod is assembled between the two second support legs.

3. The foldable sofa bed according to claim 2, wherein the first folding frame is assembled with a number of second support rods for supporting cushions at an end where the first folding frame is connected.

* * * * *